US007380347B2

(12) United States Patent
Coats et al.

(10) Patent No.: US 7,380,347 B2
(45) Date of Patent: Jun. 3, 2008

(54) CORDLESS ELECTRIC HAIR DRYER WITH CASE

(76) Inventors: Carrie R. Coats, P.O. Box 11063, Chickasaw, AL (US) 36671; Willie Coats, P.O. Box 11063, Chickasaw, AL (US) 36671

( * ) Notice: Subject to any disclaimer, the term of this patent is extended or adjusted under 35 U.S.C. 154(b) by 147 days.

(21) Appl. No.: 11/290,310

(22) Filed: Nov. 30, 2005

(65) Prior Publication Data

US 2007/0119070 A1 May 31, 2007

(51) Int. Cl.
*A45D 20/12* (2006.01)

(52) U.S. Cl. ..... 34/97

(58) Field of Classification Search ..... 34/96–100; 392/380, 384; 132/272, 212
See application file for complete search history.

(56) References Cited

U.S. PATENT DOCUMENTS 3,377,715 A * 4/1968 Hubner ..... 34/99
3,386,184 A * 6/1968 Ponczek ..... 34/99
4,635,382 A * 1/1987 Bourdeau ..... 34/97
5,124,532 A * 6/1992 Hafey et al. ..... 219/200
5,857,262 A * 1/1999 Bonnema et al. ..... 34/97
6,449,870 B1 * 9/2002 Perez et al. ..... 34/96
7,096,597 B1 * 8/2006 Zellous ..... 34/90

* cited by examiner

*Primary Examiner*—S. Gravini
(74) *Attorney, Agent, or Firm*—Raymond M. Galasso; Galasso & Associates, LP

(57) ABSTRACT

A cordless hair dryer assembly designed to be used with only with a renewable power source such as a rechargeable battery. The cordless hair dryer assembly includes a motor assembly, a fan, heating element and an on/off switch. The motor assembly is also configured with a flow controller and a temperature controller. The cordless hair dryer further includes a hose configured with a cap with a plurality of apertures for distributing the airflow.

12 Claims, 3 Drawing Sheets

CORDLESS ELECTRIC HAIR DRYER WITH CASE

FIELD OF THE INVENTION

The present invention relates a device that generates and blows hot air, more specifically but not by way of limitation, to a cordless hair dryer that is powered by a renewable power source intergrated into the hair dryer.

BACKGROUND

Individuals usually engage in daily grooming habits. Most individuals regularly wash their hair and have a subsequent need to dry their hair afterwards. Professional stylist also regular use a hair dryer to dry the hair or assist in styling the hair after it has been cut.

Conventional hair dryers have shown to have some limitations. Particularly, conventional hair dryers are powered by a standard 120 volt or 220 volt supply. The hair dryer is connected to the power supply with a cord. This creates limitations as to where the conventional hair dryer can be used. If there is no access to an electrical outlet, a conventional hair dryer can not be utilized. As a result, traditional hair dryers lack portability.

Another issue regarding the power supply of traditional hair dryers is safety. Numerous accidents occur each year as users of traditional hair dryers injure themselves when their hair dryer contacts water. As hair dryers typically operate on 1000 watts of power or more, this represents a serious safety hazard to users.

Conventional hair dryers also lack portability. Many individuals engage in camping or visiting the beach where it is desirable to dry one's hair after swimming. Without a standard 120-volt electrical outlet, traditional hair dryers cannot be utilized at campgrounds or the beach.

Accordingly, there is a need for a device that is capable of generating and moving warmer than ambient temperature air that is powered by a renewable power source. Furthermore, this power source should be integrated into the device.

SUMMARY OF THE INVENTION

It is the object of the present invention to provide a portable hair dryer that is powered with a renewable power source such as but not limited to a battery to facilitate the use of the hair dryer without the need for a standard electrical outlet during operation.

It is another object of the present invention to provide a portable hair dryer that is lightweight and easy to carry.

It is a further object of the present invention to provide a portable hair dryer that has adjustable heat controls.

Another object of the present invention is to provide a battery powered portable hair dryer that has adjustable air speeds.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
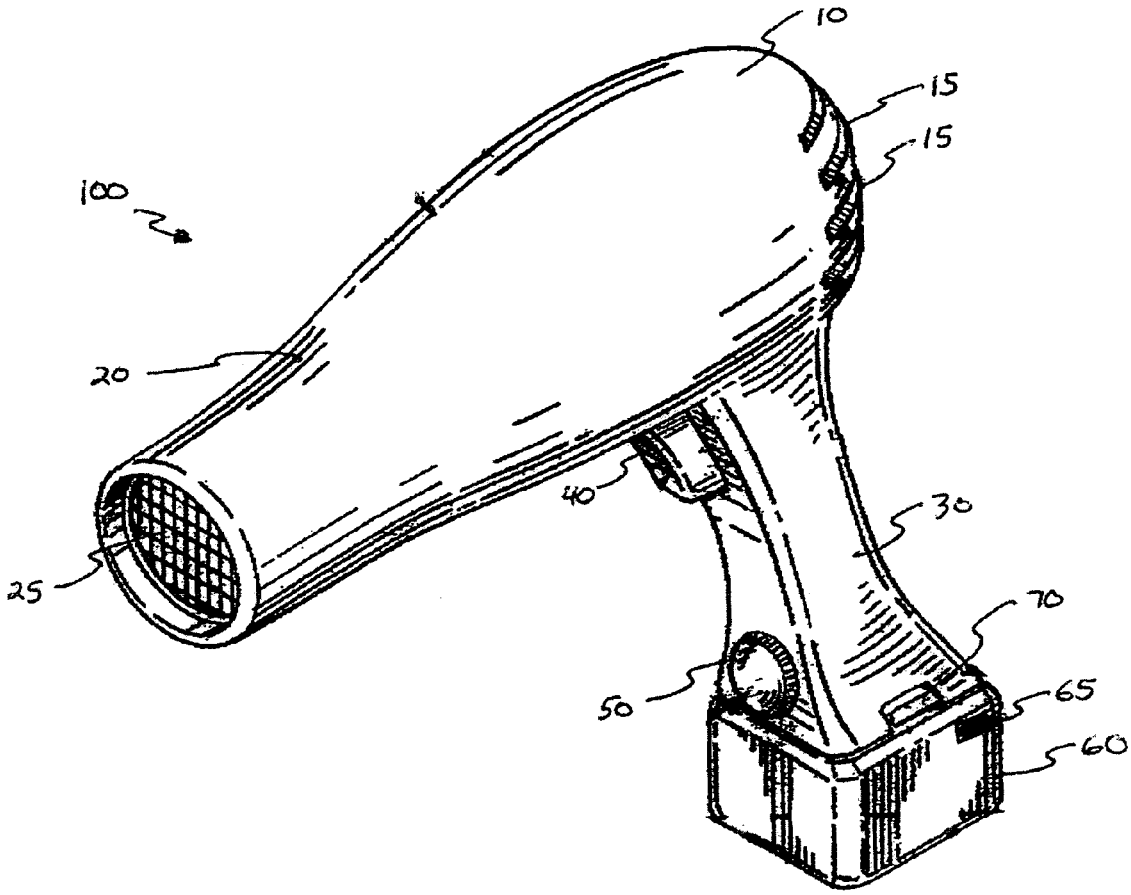
FIG. 1 illustrates a perspective view of an embodiment of the present invention.

Referring now to the drawings submitted herewith, wherein various elements depicted are not necessarily drawn to scale, and in particular FIG. 1 there is illustrated a hair dryer 100 that is constructed according to the principles of the present invention.

The hair dryer 100 comprises a housing 10 constructed of a rigid material such as but not limited to plastic. The housing 10 material must also be heat resistant to endure temperatures of up to two hundred and fifty degrees. The housing 10 has contained therein the standard components of a conventional hair dryer such as but not limited at least one heating element, a fan and a DC motor.

Integrally molded to the housing 10 is the barrel 20. The barrel 20 is generally cylindrical in shape and extends outward from the housing 10. The barrel 10 is used to direct the airflow generated from the fan in the housing 10 to a desired location. At the end of the barrel 20 distally located from the housing 10 is the screen 25. The screen 25 filters any particles that may be introduced internally to the housing 10 via a plurality of air intakes 15. The air intakes 15 allow air to enter the housing 10 when drawn in by the operating fan. The airflow is passed over the heating elements and discharged through the barrel 20. Although the barrel 20 is shown as being cylindrical in shape, it is further contemplated within the scope of the present invention that the barrel 20 could be numerous different shapes and still perform the intended function as described herein. More specifically but not by way of limitation, the barrel 10 could be oval in shape. It is also further contemplated within the scope of the present invention that the end of the barrel 20 distal to the housing 10 could be configured to receive thereon various attachments for diffusing the airflow as it exits the barrel 20.

Extending downward from the housing 10 and generally perpendicular to the barrel 20 is the handle 30. The handle 30 is integrally molded with the housing 10 and rectangular in shape. Integrated into the handle 30 and adjacently underneath the barrel 20 is a switch 40. The switch 40 is a conventional on/off switch that is used to operate the hair dryer 100. The switch 40 is positioned intermediate in the electrical circuit that is present between the DC motor in the housing 10 and the renewable power source 60 located at the end of the handle distal to the housing 10. The switch 40 has a first position in which the circuit is open and a second position in which the circuit is closed. In the second position, the hair dryer 100 is activated.

Located on the handle 30 intermediate the renewable power source 60 and the switch 40 is the temperature controller 50. The temperature controller 50 is a conventional variable switch that is positioned intermediate in the electrical circuit between the renewable power source 60 and the heating element contained in the housing 10. The temperature controller 50 variably adjusts the heat produced by the heating element by regulating the amount of current distributed to the heating elements as the temperature controller 50 is adjusted. The temperature controller 50 is a standard dial controller that allows more or less current to flow to the heating element as the dial is rotated in either a clockwise or counter-clockwise direction. Typically the temperature controller 50 is rotated clockwise to allow more current to flow to the heating element. If the user desires less heat production, the temperature controller 50 is rotated in a counter-clockwise direction.

Mounted to the handle 30 opposite the housing 10 and releasably secured thereto is the renewable power source 60. The renewable power source 60 is a rechargeable battery such as but not limited to a nickel cadmium battery. It is contemplated within the scope of the present invention that the renewable power source 60 is capable of producing electric currents required to operate the high current demands of the heating element. Once the stored energy contained in the renewable power source 60 has been depleted, the renewable power source 60 can be recharged with conventional 120 v power supply via charging receptacle 65. The charging receptacle 65 is a conventional polarized receptacle that is integrated into the renewable power source 60 adjacent to the handle. Although only the charging receptacle 65 is illustrated integrated into the renewable power source 60, it is contemplated within the scope of the present invention that the renewable power source 60 has a set of LED lights that alert the user to the current power status of the renewable power source 60. The renewable power source 60 is releasably secured to the handle via the attachment mechanism 70. The attachment mechanism 70 is a conventional mechanical fastener such as but not limited to a snap/hook device.

The renewable power source 60 is utilized in place of a traditional 120 volt power supply as it allows the hair dryer 100 to be utilized in areas where an independent power source may not be available. Further, the renewable power source 60 provides a cordless hair dryer 100 that facilitates safer use in environments that contain water sources, which create potential shock hazards.

Those skilled in the art will recognize that numerous different materials could be utilized to manufacture the housing 10 in place of and/or in conjunction with the materials suggested herein. Furthermore, one should recognize that the housing 10 be manufactured in numerous different colors such as but not limited to purple, blue, orange, pink, red, and yellow.

Figure 2:
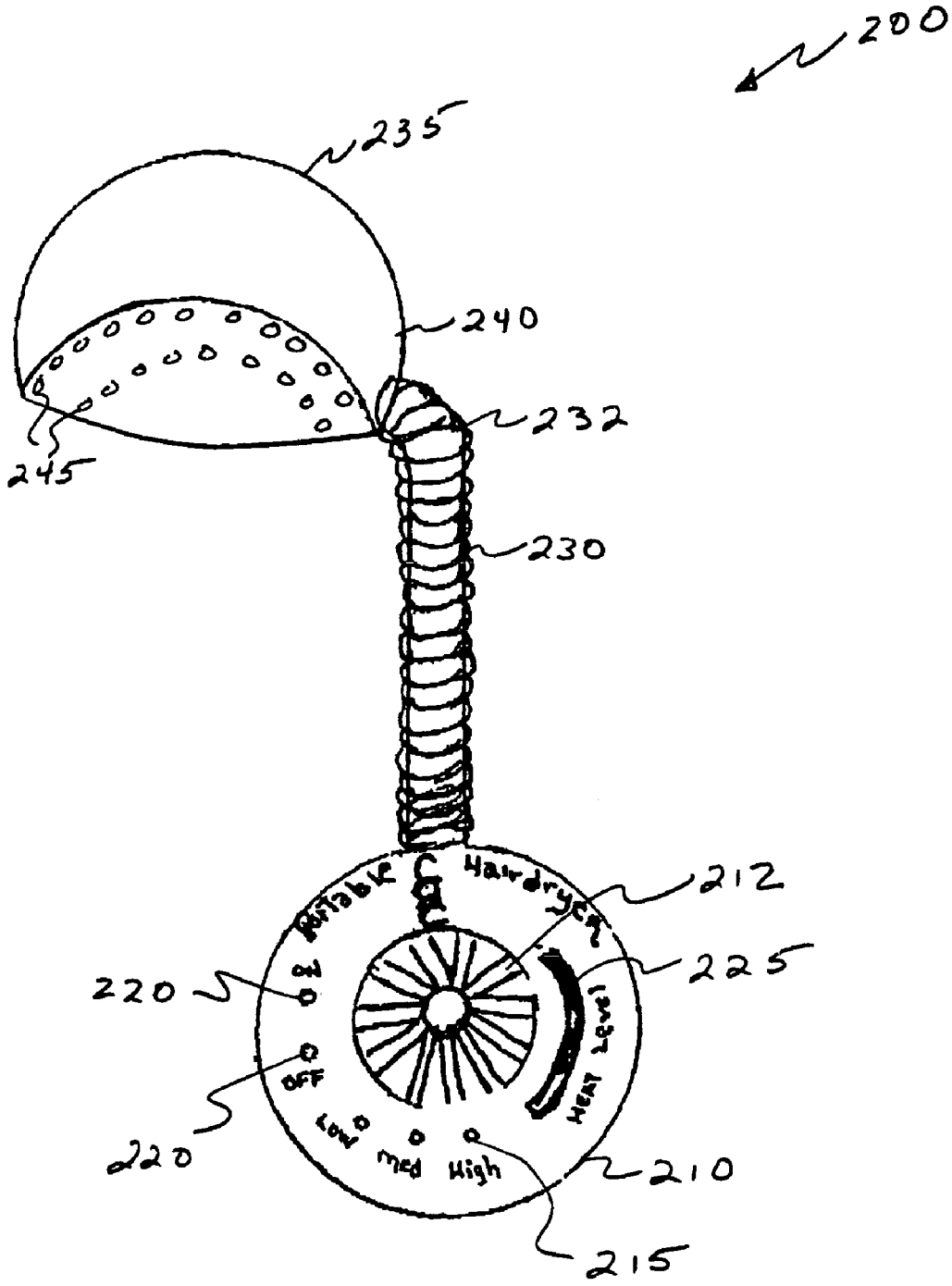
FIG. 2 illustrates a perspective view of an alternative embodiment of the present invention.
Figure 3:
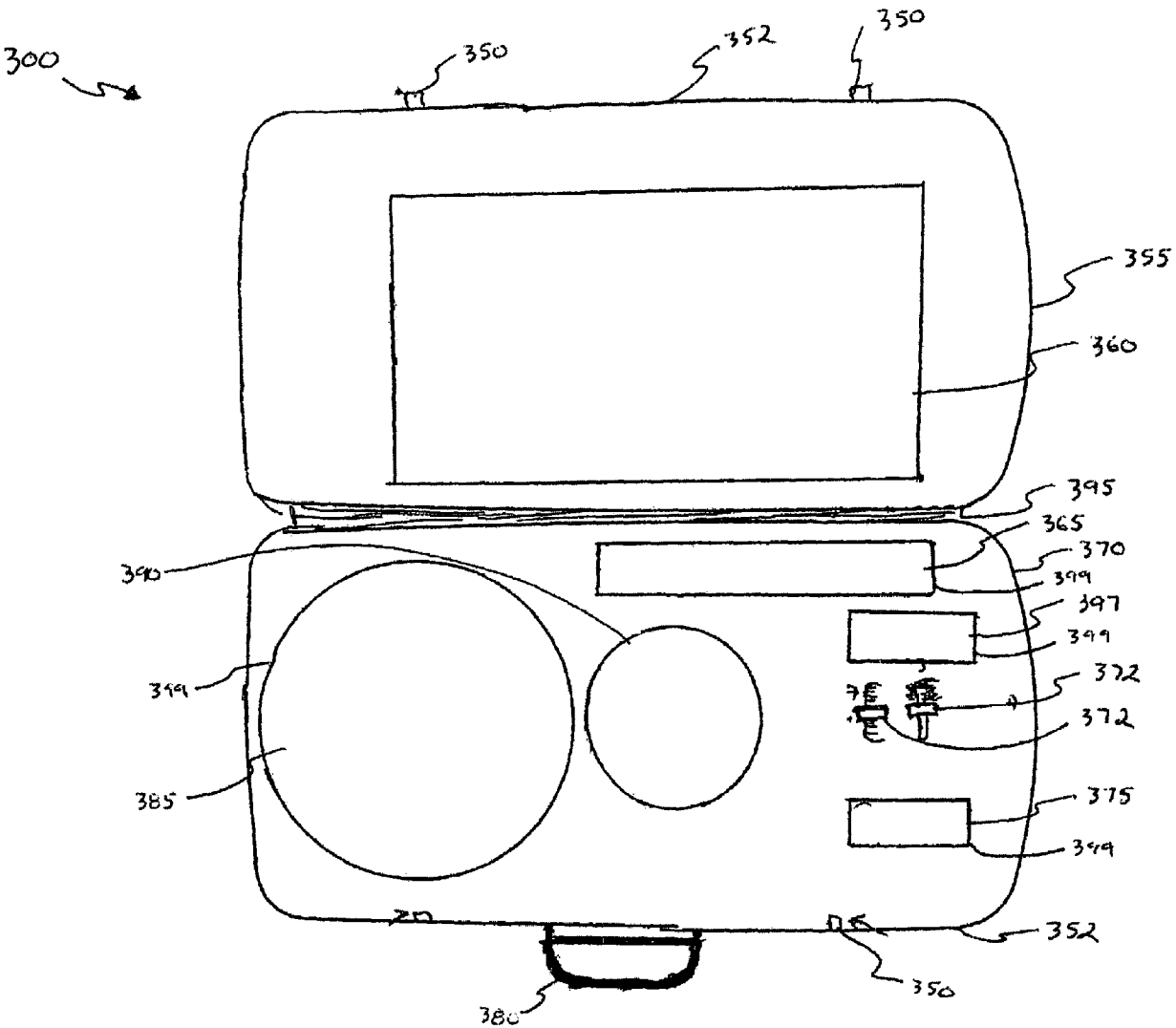
FIG. 3 illustrates a perspective view of a carrying case for the embodiment illustrated in FIG. 2.

Now referring in particular to FIGS. 2 and 3, there is an alternative embodiment illustrated of the present invention. The first component of the hair dryer assembly, the hair dryer 200 comprises a motor assembly 210. The motor assembly 210 houses conventional hair dryer components including but not limited to a variable speed fan, a DC motor and at least one heating element. The motor assembly 210 is generally annular in shape and is constructed of a suitable rigid material such as but not limited to plastic. Centrally located and integrated into the motor assembly 210 is a plurality of air intakes 212. As the fan inside the motor assembly 210 rotates it draws in air from the air intakes 212 to be passed over the heating elements and discharged from the motor assembly 210 via the hose 230. Those skilled in the art will recognize that the plastic used to manufacture the motor assembly 210 is preferably made of plastic that is heat resistant to at least 250 degrees. The motor assembly 210 also has contained therein a renewable battery. The battery is a rechargeable battery that is charged with a conventional battery charger. It is contemplated within the scope of the invention that the battery contained within the motor assembly 210 is capable of generating sufficient voltage to operate the heating element that typically require approximately 1000-1200 watts. It is further contemplated within the scope of the present invention that the fan contained within the motor assembly 210 is a conventional low-voltage DC fan.

Superposed on the exterior of the motor assembly 210 is a pair of switches 220. The switches 220 regulate the current flow in the circuit between the battery and the fan contained within the motor assembly 210. Those skilled in the art will recognize that a single on/off switch could be utilized to achieve the functionality of the switches 220 as described herein.

Mounted opposite the switches 220 integrated with the exterior of the motor assembly 210 is the temperature controller 225. The temperature controller 225 is a standard variable electric switch that allows the current produced from the battery to be regulated within a predetermined range as it is distributed to the heating elements. Although no specific range is required for the temperature controller 225, good results have been achieved with a range between 125 and 250 degrees.

Intermediate the switches 220 and the temperature controller 225 are the airflow controllers 215. The airflow controllers 215 are conventional electric switches that adjust the current flow between the battery and the DC fan. This alters the speed at which the fan rotates thus controlling the volume of air heated and discharged. Although it is shown in the illustrated embodiment that three airflow controllers 215 are present, it is contemplated within the scope of the present invention that numerous different airflow controller 215 configuration could be used in place of and/or in conjunction with the airflow controllers 215 as illustrated. More specifically but not by way of limitation, the airflow controller 215 could be a single variable switch.

Located on the top portion of the motor assembly is the hose 230. The hose 230 allows the air drawn into the motor assembly 210 through the air intakes 212 to exit the motor assembly and transport the air to the cap 235. The hose 230 is constructed of a suitable semi-rigid flexible material such as but not limited to plastic. Those skilled in the art will recognize that the hose 230 is constructed of a plastic is resistant to high temperatures. It is further contemplated within the scope of the present invention that the hose 230 is constructed with an internal support coil to prevent collapse of the hose material upon prolonged exposure to high heat. The second end 232 of the hose 230 is contiguous with a cap 235. The cap 235 is constructed of a suitable flexible material such as heat resistant plastic. The cap 235 is designed to releasably secure to a human head. A string 240 that is circumferentially disposed along the cap 235 is designed to releasably secure the cap 235 to a human head.

Substantially disposed on the interior of the cap 235 is a plurality of apertures 245. The apertures 245 are configured to be the outlets for the air flow that was introduced into the cap 235 by the hose 230. The apertures 235 are evenly dispersed and contiguous with the interior of the cap 235 in order to provide sufficient airflow to the adjacent human head. Those skilled in the art will recognize that numerous different configurations of the apertures 245 could be used in place of and/or in conjunction with the apertures 245 as illustrated in the accompanying drawings to perform the intended function as described herein.

Now referring in particular to FIG. 3, the second component of the hair dryer assembly is a carrying case 300. The case 300 is generally rectangular in shape and hollow for receipt therein of the hair dryer 200 components. The case 300 includes an upper portion 355 and a lower portion 370 that are fastened with a conventional piano hinge 395. Mounted by conventional mechanical methods along the peripheral edge 352 of the upper portion 355 and the lower portion 370 are a pair of opposing fasteners 350. The fasteners 350 are manufactured from a conventional hook and loop fastener and are designed to releasably secure the upper portion 355 to the lower portion 370 in a second position in which the case 300 is closed. In the first position, the case 300 is open allowing access to the components of the hair dryer 200 contained in specialized containers 399 integrally molded into the lower portion 370 of the case 300. Substantially disposed internally in the upper portion 355 is a mirror 360. The mirror 360 is mounted by conventional chemical methods such as but not limited to chemical adhesives.

Molded into the lower portion 370 are a motor compartment 385, cap compartment 395, hose compartment 365, charger compartment 397, battery compartment 375, and at least one grooming device compartment 372. All of the compartments 399 are formed with a suitable rigid material such as but not limited to thermoplastic. As is known to those skilled in the art, a thermoplastic is a high polymer that softens when exposed to heat and returns to its original condition when cooled to room temperature. Suitable thermoplastics include but are not limited to, nylon, polystyrene, polypropylene, and acrylic resins. It is preferred that the thermoplastic material be one that can be readily injection molded and is non-toxic. Thermoplastics also provide the opportunity to use a variety of different colors to manufacture hair dryer 200 and case 300. It is contemplated within the scope of the present invention that the hair dryer 200 and case 300 could be manufacture in the colors purple, blue, orange, pink, red, and yellow. The containers 399 should be molded to sufficient shape to accommodate therein there intended component. The motor compartment 385 should be generally annular in shape and of sufficient diameter to accommodate the motor assembly 210. All other containers 399 are configured in a similar manner to mate with the shape of the device to be retained therein. Although no specific measurements of the case 300 are required, good results have been achieved with a case that is 12.5 inches in length, four inches in height and three inches in depth.

Although good results have been achieved with the described embodiment of the present invention utilizing the renewable power source to power both the heating element and the fan, it is contemplated to be within the scope of this invention that other types of mechanisms could be utilized to power the heating elements. For example, but not by way of limitation, the hair dryer could be configured to utilized a rechargeable battery pack to power the fan, while a butane power heating system could be utilized to heat the heating element of the hair dryer.

It is further contemplated that various types of clip attachments could be utilized on the present invention to facilitate easy movement and portability of the hair dryer.

Referring in particular to the drawings submitted herewith, more specifically FIG. 1, a description of the operation of the hair dryer 100 is as follows. In use, the user charges the renewable power source 60 using the charging receptacle 65 until the renewable power source 60 is charged to capacity. Once charged, the hair dryer 100 can be transported to a desired location where its use will be required. The user will engage the switch 40 to activate the fan contained in the housing 10 and select the desired temperature level of the airflow exiting the barrel 20 with the temperature controller 50. The user will then direct the airflow to the material that needs to be dried, such as but not limited to hair. Once dry, the user will engage the switch 40 to disengage the fan and heating element contained in the housing. The user will periodically charge the renewable power source as needed and repeat the process as described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A cordless hair dryer assembly comprising:

a carrying case configured to receive therein the cordless hair dryer, wherein the carrying case is a separate separable component from the hair dryer;

a motor assembly, said motor assembly having therein a DC motor, said motor connected to a fan, said motor assembly further including at least one heating element, said fan for creating airflow;

a hose connected proximate said fan, said hose for directing the airflow created by said fan;

a temperature controller, said temperature controller for regulating the current from the renewable power source to the heating elements;

a cap, said cap mounted to said hose, said cap for receiving and distributing the airflow from said hose; and a storage compartment, said storage compartment generally hollow and rectangular in shape, said storage compartment configured to receive therein said motor assembly, said hose and said cap.

2. The cordless hair dryer assembly as recited in claim 1, and further including a renewable power source, said renewable power source being located internally in said motor assembly, said renewable power source being removable.

3. The cordless hair dryer assembly as recited in claim 2, and further including at least one switch, said switch for controlling said DC motor.

4. The cordless hair dryer assembly as recited in claim 3, and further including at least one flow controller, said flow controller for controlling the speed of said fan, said flow controller being variable.

5. The cordless hair dryer assembly as recited in claim 1, wherein at least a portion of said cap has substantially disposed thereon a plurality of apertures, said apertures for distributing the airflow entering said cap from said hose.

6. The cordless hair dryer assembly as recited in claim 5, and further including a string, said string circumferentially disposed on said cap, said string for releasably securing said cap to a human head.

7. A battery operated hair dryer assembly having a carrying case comprising:

a motor assembly, said motor assembly having therein a DC motor, said motor connected to a fan, said motor assembly further including at least one heating element, said motor assembly being circular in shape, said motor assembly further including a plurality of air intakes, said air intakes being centrally located on said motor assembly;

a battery, said battery being a rechargeable nickel cadmium battery, said battery capable of producing sufficient current for supplying power to said fan and said heating element;

a hose, said hose having a first end and a second end, said first end of said hose being mounted to said motor assembly, said hose for directing airflow as the airflow is produced from said motor assembly;

a temperature controller, said temperature controller for regulating the current from said nickel cadmium battery to said heating elements;

a cap, said cap mounted to said hose, said cap for receiving and distributing the airflow from said second end of said hose, said cap being configured to receive therein a human head, said cap having substantially disposed on one side a plurality of apertures, said apertures being configured to distribute the airflow received from said hose; and a storage compartment, said storage compartment generally hollow and rectangular in shape, said storage compartment having two generally equal portions, said portions being hingably attached along one side, said storage compartment having containers to receive therein said motor assembly, said hose and said cap, said storage compartment further including a mirror substantially disposed on one of said portions, wherein said storage compartment is a separate separable component from said motor assembly, hose and cap.

8. The battery-operated hair dryer as recited in claim 7, and further including a switch, said switch for regulating the current flow between the battery and the fan.

9. The battery-operated hair dryer as recited in claim 8, and further including 3 flow controllers, said flow controllers for controlling the speed of said fan.

10. The battery-operated hair dryer as recited in claim 9, and further including temperature controller, for regulating the current from the renewable power source to the lasting elements.

11. The battery-operated hair dryer as recited in claim 10, wherein said storage compartment further includes at least one container designed to receive a hair comb or brush therein.

12. The battery-operated hair dryer as recited in claim 11, and further including a string, said string circumferentially disposed on said cap, said string for releasably securing said cap to a human head.

* * * * *